US007526231B2

(12) United States Patent
Funamoto

(10) Patent No.: US 7,526,231 B2
(45) Date of Patent: Apr. 28, 2009

(54) DRIVEN UNIT INSTALLABLE IN AN IMAGE FORMING APPARATUS WITH A REDUCED FORCE

(75) Inventor: Noriaki Funamoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 254 days.

(21) Appl. No.: 11/500,306

(22) Filed: Aug. 8, 2006

(65) Prior Publication Data

US 2007/0036586 A1 Feb. 15, 2007

(30) Foreign Application Priority Data

Aug. 8, 2005 (JP) ..... 2005-229188

(51) Int. Cl.
*G03G 15/01* (2006.01)

(52) U.S. Cl. ..... 399/167

(58) Field of Classification Search ..... 399/320, 399/167

See application file for complete search history.

(56) References Cited

U.S. PATENT DOCUMENTS 5,579,098 A * 11/1996 Noguchi et al. ..... 399/122
2005/0058470 A1 3/2005 Funamoto et al.
2005/0084293 A1 4/2005 Fukuchi et al.
2005/0111882 A1* 5/2005 Sudo et al. ..... 399/222
2006/0056868 A1 3/2006 Ebara et al.

FOREIGN PATENT DOCUMENTS

JP 62-237476 10/1987
JP 11-315891 11/1999
JP 2005017668 A * 1/2005

OTHER PUBLICATIONS

U.S. Appl. No. 11/342,724, filed Jan. 31, 2006, Noriaki Funamoto, et al.

* cited by examiner

*Primary Examiner*—Quana M Grainger
(74) *Attorney, Agent, or Firm*—Oblon, Spivak, McClelland, Maier & Neustadt, P.C.

(57) ABSTRACT

An image forming apparatus includes a driver unit, a driver control unit, a drive gear, a drive-force output gear, and a driven unit. The drive gear is driven by the driver unit. The drive-force output gear is driven with the drive gear. The driven unit, detachable from the image forming apparatus, includes a rotating member, and a drive-force input gear. The drive-force input gear, engageable with the drive-force output gear when the driven unit is installed into the image forming apparatus, rotates the rotating member. The driver control unit controls the driver unit at a first driving speed to contact the drive gear to the drive-force output gear after an installation of the, driven unit. The driver control unit also controls the driver unit at a second driving speed for image forming operation. The first driving speed is set to a slower speed compared to the second driving speed.

7 Claims, 12 Drawing Sheets

DRIVEN UNIT INSTALLABLE IN AN IMAGE FORMING APPARATUS WITH A REDUCED FORCE

TECHNICAL FIELD

The present disclosure generally relates to an image forming apparatus including a driven unit, detachable from an image forming apparatus and having a rotating member to be connected to a driver unit in an image forming apparatus.

BACKGROUND

In general, an image forming apparatus employs a drive-force transmission mechanism (e.g., gear transmission mechanism) to transmit a driving force from a driver unit to a driven unit via rotating members such as gear. Such driver unit is fixed in the image forming apparatus, and such driven unit maybe detachable from the image forming apparatus.

The driver unit includes a drive-force output gear, and the driven unit includes a drive-force input gear, for example.

When the driven unit is set in a given installation position in the image forming apparatus, the drive-force output gear and drive-force input gear can engage under a given condition.

When the driven unit is installed in the image forming apparatus, the drive-force input gear of the driven unit contacts the drive-force output gear at first. Then, either one of the gears rotates to some degree so that the both gears can engage in a proper condition.

In such image forming apparatus, the driver unit and drive-force output gear may be connected each other by a first drive-force transmission mechanism, and the driven unit and the drive-force input gear may be connected with each other by a second drive-force transmission mechanism, wherein such transmission mechanisms connect components such as gear.

Accordingly, when installing the driven unit in the image forming apparatus, the driven unit may receive a load stress from the driver unit or the above-mentioned transmission mechanisms because the drive-force input gear and drive-force output gear contact and rotate with each other as above-mentioned.

In such condition, a user may need to exert a force, which overcomes such load stress when installing the driven unit in the image forming apparatus, which is not a user-friendly phenomenon.

FIG. 1 shows one related art of drive-force transmission system in an image forming apparatus.

As shown in FIG. 1, a driven unit includes a drive-force input gear 123, and a drive-force output gear 134 is provided in the image forming apparatus, wherein the drive force input gear 123 can engage the drive-force output gear 134.

As shown in FIG. 1, the drive-force output gear 134 concentrically engages a drive-force transmission gear 133 with a rotational shaft 135 as a common shaft, which is driven by a driver unit (not shown). Therefore, the drive-force output gear 134 and drive-force transmission gear 133 are rotatably supported by the rotation shaft 135.

As shown in FIG. 2, the drive-force output gear 134 includes two first projections 134*a*, wherein the two first projections 134*a* extend in an axial direction of the drive 5 force output gear 134 and face the drive-force transmission gear 133.

The two first projections 134*a* are provided with a same interval on the circumference of the drive-force output gear 134 as shown in FIG. 2.

As shown in FIG. 3, the drive-force transmission gear 133 includes two second projections 133*b*, wherein the two second projections 133*b* extend in an axial direction of the drive-force transmission gear 133 and face the drive-force output gear 134.

The second projections 133*b* are provided with the same interval on the circumference of the drive-force transmission gear 133 as shown in FIG. 3.

As shown in FIG. 1, the first projections 134*a* and second projections 133*b* may contact each other when the drive-force transmission gear 133 rotates around the rotational shaft 135.

Accordingly, when the drive-force transmission gear 133 rotates by a driving force from the driver unit, the second projections 133*b* contact the first projections 134*a* of the drive-force output gear 134.

With maintaining a contact condition of the first projections 134*a* and second projections 133*b*, the drive-force output gear 134 rotates with the drive-force transmission gear 133, wherein the drive-force output gear 134 and drive-force transmission gear 133 have the rotational shaft 135 as a common shaft.

As shown in FIG. 1, the image forming apparatus includes a play between the first projections 134*a* and second projections 133*b*.

When installing the driven unit in the image forming apparatus, the drive-force input gear 123 contacts the drive-force output gear 134 in the image forming apparatus.

Under this condition, if the drive-force output gear 134 can be rotated within the above-mentioned play, the drive-force output gear 134 may be rotated without receiving a load stress from the drive-force transmission system in the driven unit or driver unit.

In such image forming apparatus, after installing the driven unit in the image forming apparatus, the driver unit is driven to contact the first projections 134*a* and second projections 133*b*, which are in a non-contact condition, before starting an image forming operation in the image forming apparatus.

After contacting the first projections 134*a* and second projections 133*b*, the driver unit is driven again to start the image forming operation in the image forming apparatus.

However, when the first projections 134*a* and second projections 133*b* contact each other, the first projections 134*a* and second projections 133*b* may impact each other with some speed, by which a larger load stress may be applied to the driver unit or tooth plane of gears (e.g., 123, 133) instantaneously, and may result in a malfunction of drive-force transmission system of the image forming apparatus.

In another related art, an image forming apparatus includes a developing unit detachable from the image forming apparatus. The developing unit includes a drive-force input gear and developing sleeve (as rotating member), which are connected by a common rotation shaft.

Similarly to the above-mentioned drive-force transmission gear 133 and drive-force output gear 134, the drive-force input gear and the rotational shaft of the developing sleeve include projections to be contacted each other.

Accordingly, when the drive-force input gear rotates with a driving force by a driver unit, projections on the drive-force input gear contact projections on the rotational shaft of the developing sleeve, by which the developing sleeve can rotate.

Play is also provided between the projections on the drive-force input gear and projections on the rotational shaft of the developing sleeve.

When the developing unit is installed in such image forming apparatus, the drive-force input gear of developing unit contacts a drive-force output gear in the image forming apparatus, and the drive-force input gear rotates within the play between the above-mentioned projections.

Furthermore, such image forming apparatus includes a coil spring between the rotation shaft of the developing sleeve and drive-force input gear.

The coil spring applies a bias force to the rotational shaft of the developing sleeve and drive-force input gear so that the projections can contact each other when the developing sleeve rotates in a first direction.

Such bias force of the coil spring is smaller than a rotational torque of the developing sleeve, and the drive-force input gear of the developing unit rotates in a second direction, which is opposite to the first direction when installing the developing unit in the image forming apparatus. A load stress which may be generated by the bias force of the coil spring when installing the developing unit in the image forming apparatus may be smaller than a stress caused by a rotation of the developing sleeve.

When the developing unit is installed in the image forming apparatus, the above-mentioned projections may be in a non-contact condition.

Therefore, when the developing unit is activated for the first time after installing the developing unit, the above-mentioned projections may impact each other with a some speed, by which a larger load stress may be applied to a driver unit or tooth plane of gears in the image forming apparatus instantaneously, and may result in a malfunction of drive-force transmission system in the image forming apparatus.

With the advent of barrier-free trend and universal design, manufactures have been requested to produce machines or tools having improved accessibility for people including disabilities. For example, the Rehabilitation Act of the United States requires federal agencies to make their electronic and information technology accessible to people with disabilities. Under such circumstances, it is desirable to manufacture an image forming apparatus having improved accessibility and operability for people including disabilities. For example, it is preferable that an operator can install a driven unit into the image forming apparatus with less operating force.

SUMMARY

The present disclosure relates to an image forming apparatus including a driver unit, a driver control unit, a drive gear, a drive-force output gear, and a driven unit. The driver unit is integrated to the image forming apparatus. The driver control unit controls the driver unit. The drive gear has a first contact portion and is connected to the driver unit. The drive gear is driven with a driving force of the driver unit. The drive-force output gear has a second contact portion and is connected to the drive gear with a common shaft. The drive-force output gear is driven with the drive gear, and the drive-force output gear is relatively rotatable with respect to the drive gear. The driven unit is detachably provided in the image forming apparatus, and includes a rotating member, and a drive-force input gear. The drive-force input gear is connected to the rotating member to rotate the rotating member, and the drive-force input gear is contactable with the drive-force output gear when the driven unit is installed into the image forming apparatus, and is engageable with the drive-force output gear with rotation of at least one of the drive-force input gear and drive-force output gear in one direction. The drive gear is rotated by the driving force of the driver unit to contact the first contact portion of the drive gear to the second contact portion of the drive-force output gear after installing the driven unit in the image forming apparatus so that the drive gear and drive-force output gear are integrally rotatable. The driver control unit controls the driver unit at a first driving speed to rotate the drive gear, by which the first contact portion of the drive gear is contacted to the second contact portion of the drive-force output gear, and the driver control unit controls the driver unit at a second driving speed, by which the image forming apparatus conducts an image forming operation after the first contact portion of the drive gear is contacted to the second contact portion of the drive-force output gear. The first driving speed is set to a slower speed as compared with the second driving speed.

The present disclosure further relates to a method of installing a driven unit in an image forming apparatus having a drive gear, a drive-force output gear including the steps of receiving, first setting, activating, judging, deactivating, and second setting. The receiving step receives a signal indicating an installation of the driven unit in the image forming apparatus, in which the driven unit is engaged to the drive-force output gear. The first setting step sets a first start-up time and first driving speed to the driver unit to contact a first contact portion of the drive gear to a second contact portion of the drive-force output gear. The activating step activates the driver unit with the first start-up time and first driving speed to rotate the drive gear with respect to the drive-force output gear. The judging step judges whether a given time has passed after activating the driver unit, wherein the first contact portion of the drive gear starts to contact the second contact portion of the drive-force output gear at the given time. The deactivating step deactivates the driver unit when the given time has passed after activating the driver unit. The second setting step sets a second start-up time and second driving speed to the driver unit to start an image forming operation, wherein the second start-up time and second driving speed are set smaller than the first start-up time and first driving speed.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF THE PREFERRED EMBODIMENTS

Figure 1:
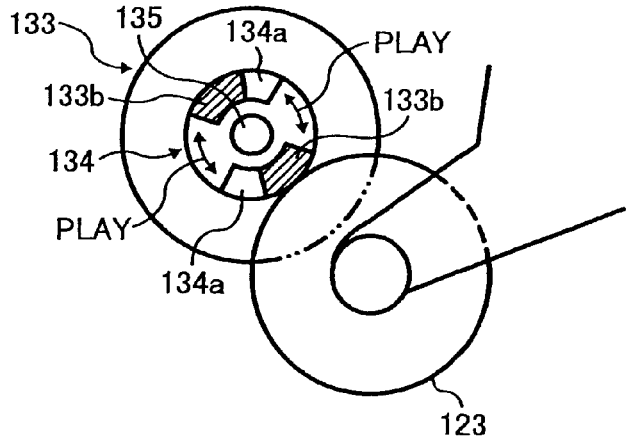
FIG. 1 PRIOR ART
FIG. 1 is a schematic view of a conventional drive-force transmission system for a driven unit in an image forming apparatus.

In describing example embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Figure 4:
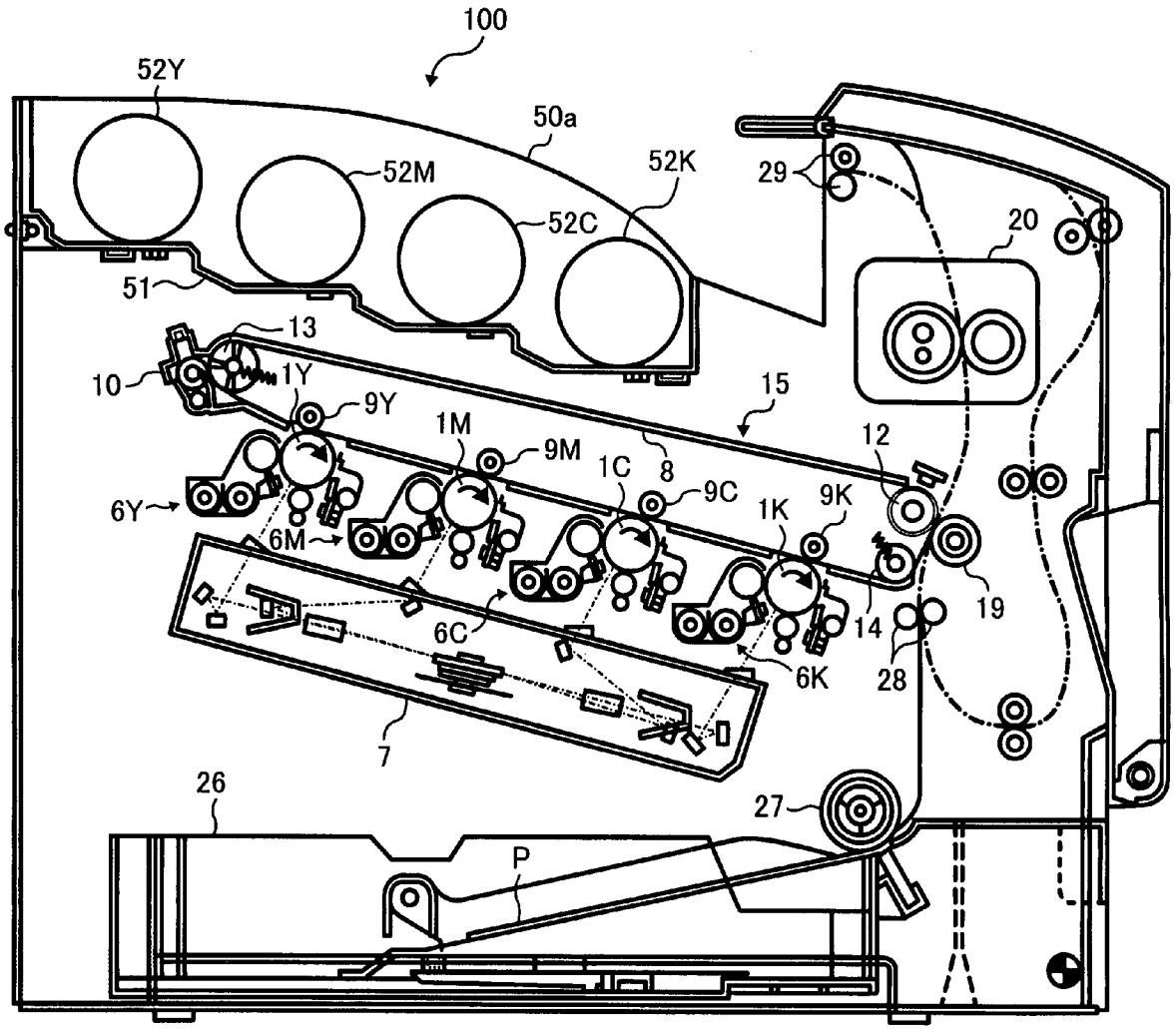
FIG. 4 is a schematic cross-sectional view of an image forming apparatus according to an example embodiment.

Referring now to the drawings, wherein like reference numerals designate identical or corresponding parts throughout the several views, an image forming apparatus according to an example embodiment is described with particular reference to FIG. 4.

FIG. 4 is a schematic view of an image forming apparatus according to an example embodiment.

As shown in FIG. 4, an image forming apparatus 100 includes process cartridges 6Y, 6M, 6C, 6K, an optical writing unit 7, an intermediate transfer belt 8, an intermediate transfer unit 15, a fixing unit 20, and a sheet cassette 26, for example.

The process cartridges 6Y, 6M, 6C, and 6K are used to form toner images of yellow, magenta, cyan, and black on the intermediate transfer belt 8. The process cartridges 6Y, 6M, 6C, and 6K take a similar configuration one to another except color of toners. Hereinafter, "Y, M, C, and K" respectively represent "yellow, magenta, cyan, and black."

Each of the process cartridges 6Y, 6M, 6C, and 6K is detachable to the image forming apparatus 100. With such configuration, when the process cartridges 6Y, 6M, 6C, and 6K have come to an end of its lifetime, the process cartridges 6Y, 6M, 6C, and 6K can be removed from the image forming apparatus 100, and replaced with a new process cartridge.

Hereinafter, the process cartridge 6Y for forming a yellow toner image is explained as a representative of the process cartridges 6Y, 6M, 6C, and 6K.

Figure 5:
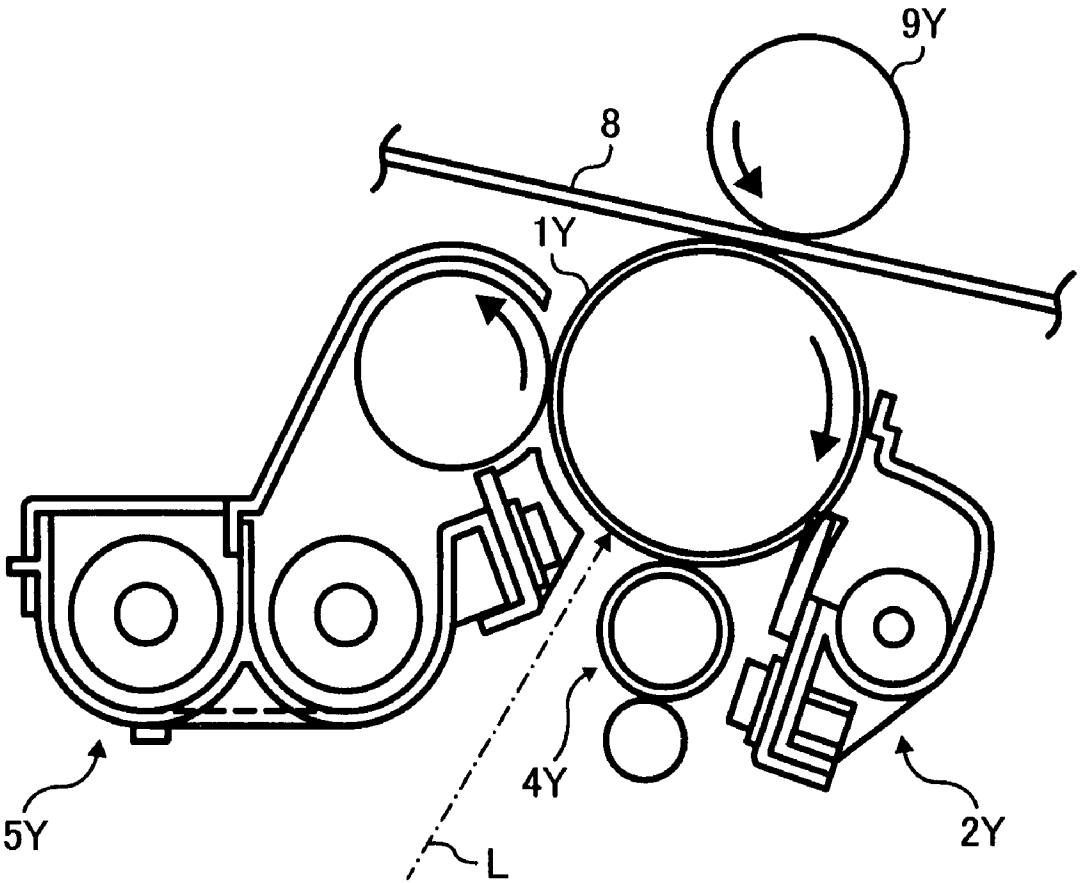
FIG. 5 is a schematic cross-sectional view of a process cartridge provided in an image forming apparatus in FIG. 4.

FIG. 5 is a schematic view of the process cartridge 6Y for forming yellow toner image.

As shown in FIG. 5, the process cartridge 6Y includes a photosensitive drum 1Y, a drum cleaning unit 2Y, a charging unit 4Y, a developing unit 5Y, and a de-charging unit (not shown), for example.

The photosensitive drum 1Y functions as electrostatic latent image carrying member, and is driven by a drum driving unit (not shown).

Figure 2:
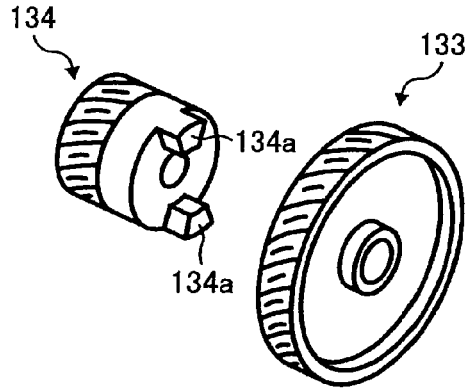
FIG. 2 PRIOR ART
FIG. 2 is a schematic view of a drive-force transmission gear and drive-force output gear used in a drive-force transmission system in FIG. 1.
Figure 3:
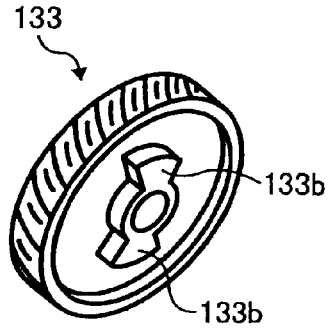
FIG. 3 PRIOR ART
FIG. 3 is a schematic view of a drive-force transmission gear used in a drive-force transmission system in FIG. 1.

The charging unit 4Y uniformly charges a surface of the photosensitive drum 1Y rotating in a clockwise direction in FIG. 2.

Then, the surface of photosensitive drum 1Y is scanned by a laser beam L to form an electrostatic latent image for yellow image on the surface of photosensitive drum 1Y.

The electrostatic latent image is developed by the developing unit 5Y as yellow toner image, and then the yellow toner image is transferred to the intermediate transfer belt 8.

After transferring the toner image to the intermediate transfer belt 8, the drum cleaning unit 2Y removes toners remaining on the surface of the photosensitive drum 1Y.

After cleaning the surface of the photosensitive drum 1Y, the de-charging unit (not shown) de-charges the surface of the photosensitive drum 1Y to prepare for a next image forming operation.

In a similar manner, the process cartridges 6M, 6C, and 6K form a magenta, cyan, and black toner image on the respective photosensitive drums 1M, 1C, and 1K, and then such toner images are transferred to the intermediate transfer belt B.

As show in FIG. 4, the optical writing unit 7 is provided below the process cartridges 6Y, 6M, 6C, and 6K.

The optical writing unit 7 emits the laser beam L to each of the photosensitive drums 1Y, 1M, 1C, and 1K in the process cartridges 6Y, 6M, 6C, and 6K based on image information. With such laser beam, an electrostatic latent image is formed on each of the photosensitive drum 1Y, 1M, 1C, and 1K.

The optical writing unit 7 includes a light source, polygon mirror, lenses and mirrors, for example. The laser beam L coming from the light source is deflected by the polygon mirror, which is driven by a motor, and then irradiated to each of the photosensitive drum 1Y, 1M, 1C, and 1K via the lenses and mirrors.

As shown in FIG. 4, the image forming apparatus 100 includes the sheet cassette 26, a feed roller 27, and a pair of registration rollers 28 in a lower portion of the image forming apparatus 100.

The sheet cassette 26 stores a plurality of transfer sheets P, and a top sheet of the transfer sheet P is contacted to the feed roller 27.

When the feed roller 27 is rotated in a counterclockwise direction in FIG. 4 by a driver (not shown), the top sheet of transfer sheet P is fed to the pair of registration rollers 28.

The pair of registration rollers 28 rotate to sandwich the transfer sheet P therebetween, and are stopped for some time. Then, the pair of registration rollers 28 rotate again to feed the transfer sheet P to a secondary transfer nip (to be described later) at a given timing.

As shown in FIG. 4, the image forming apparatus 100 includes the intermediate transfer unit 15 over the process cartridges 6Y, 6M, 6C, and 6K.

The intermediate transfer unit 15 includes the intermediate transfer belt 8, a belt cleaning unit 10, primary transfer rollers 9Y, 9M, 9C, 9K, a secondary transfer backup roller 12, a cleaning backup roller 13, and a tension roller 14.

The intermediate transfer belt 8 is extended by such rollers, and travels in a counterclockwise direction in FIG. 4 with rotation of at least one of such rollers provided in the intermediate transfer unit 15.

Each of the primary transfer rollers 9Y, 9M, 9C, and 9K forms a primary transfer nip with each of the photosensitive drums 1Y, 1M, 1C, and 1K on the intermediate transfer belt 8 as shown in FIG. 4.

In such configuration, the primary transfer rollers 9Y, 9M, 9C, and 9K apply a transfer bias voltage on an inner face of the intermediate transfer belt 8, which is opposite (e.g., positive voltage) to a polarity of toner (e.g., negative voltage).

The above-mentioned rollers in the intermediate transfer unit 15, except primary transfer rollers 9Y, 9M, 9C, and 9K, are earthed to the ground.

When the intermediate transfer belt 8 passes through each of the primary transfer nip for photosensitive drums 1Y, 1M, 1C, and 1K, a yellow, magenta, cyan, and black toner image are sequentially transferred onto the intermediate transfer belt 8, by which a four color toner image is formed on the intermediate transfer belt 8.

The intermediate transfer unit 15 includes a separation mechanism (not shown) for separating the photosensitive drums 1Y, 1M, and 1C from the intermediate transfer belt 8 while maintaining contact of the intermediate transfer belt 8 with the photosensitive drum 1K when conducting monochrome image forming in the image forming apparatus 100.

As shown in FIG. 4, the secondary transfer backup roller 12 forms a secondary transfer nip with a secondary transfer roller 19 by sandwiching the intermediate transfer belt 8 therebetween.

The four color toner image formed on the intermediate transfer belt 8 is transferred to the transfer sheet P at the secondary transfer nip.

After transferring the four color toner image from the intermediate transfer belt 8 to the transfer sheet P at the secondary transfer nip, the belt cleaning unit 10 removes toners remaining on the intermediate transfer belt 8.

At the secondary transfer nip, the intermediate transfer belt 8 and secondary transfer roller 19 moves in the same direction. With such movement, the transfer sheet P is transported toward the fixing unit 20. The fixing unit 20 is detachable from the image forming apparatus.

The fixing unit 20 applies heat and pressure to the transfer sheet P to fix a full color toner image on a surface of the transfer sheet P.

Then, the transfer sheet P is ejected out of the image forming apparatus 100 by a pair of ejection rollers 29.

The image forming apparatus 100 includes a stack 50*a* on its top face as shown in FIG. 4. The transfer sheet P ejected by the pair of ejection rollers 29 is stacked on the stack 50*a*.

As shown in FIG. 4, the image forming apparatus 100 includes a bottle compartment 51 between the intermediate transfer unit 15 and stack 50*a*, for example.

The bottle compartment 51 includes toner bottles 52Y, 52M, 52C, and 52K for storing each color of yellow, magenta, cyan, and black. The toner in each of the toner bottles 52Y, 52M, 52C, and 52K can be supplied to the developing unit 5 in each of the process cartridges 6Y, 6M, 6C, and 6K by a toner supply unit (not shown), as required.

Each of the toner bottles 52Y, 52M, 52C, and 52K is 5 detachable from the image forming apparatus 100, wherein such detachment can be conducted independently from a detachment of process cartridges 6Y, 6M, 6C, and 6K.

Hereinafter, the fixing unit 20 according to an example embodiment is explained.

Figure 6:
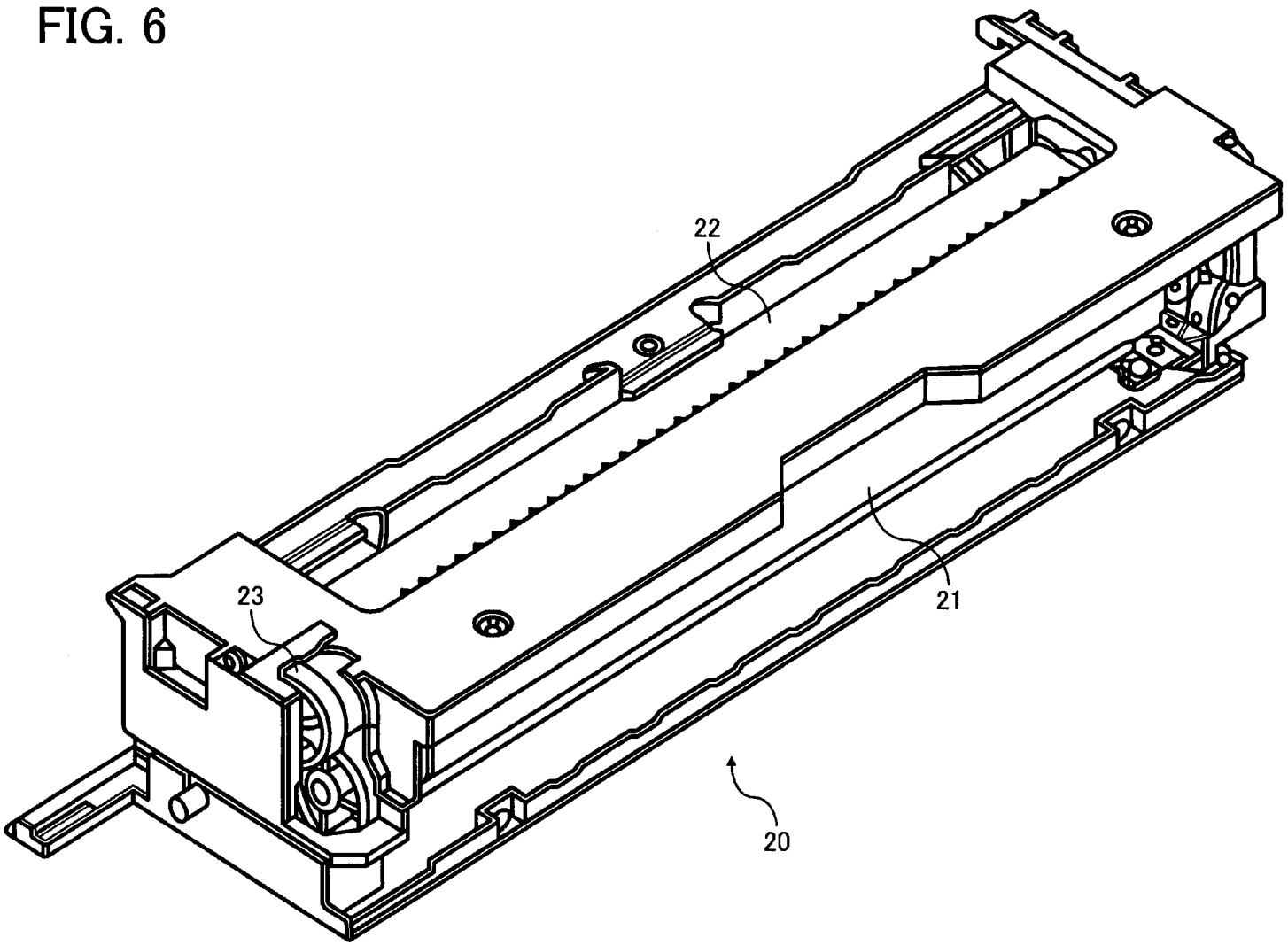
FIG. 6 is a perspective view of a fixing unit used in an image forming apparatus in FIG. 4.
Figure 7:
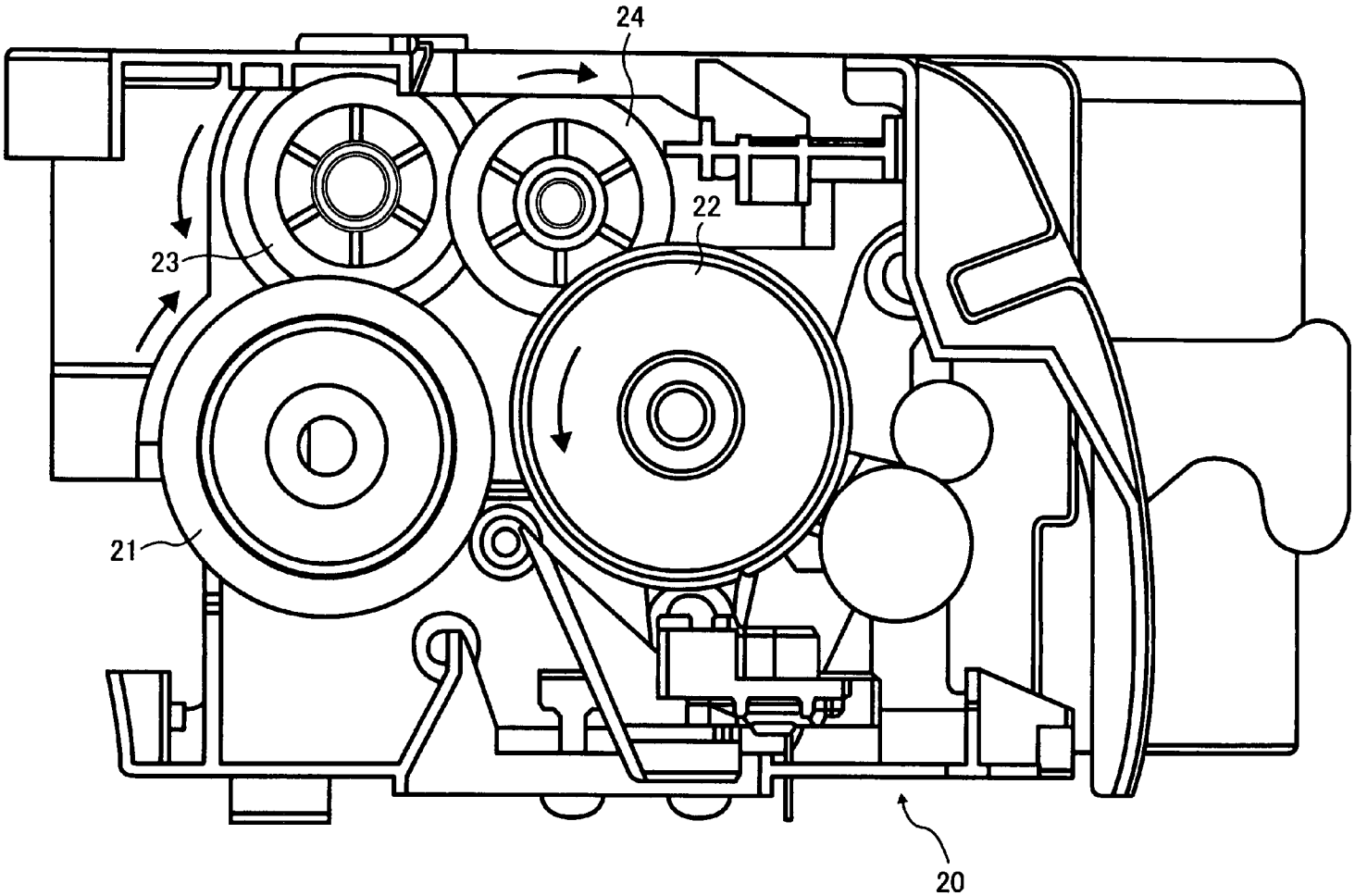
FIG. 7 is a schematic cross-sectional view of one end portion of the fixing unit in FIG. 6.

FIG. 6 is a perspective view of the fixing unit 20. FIG. 7 is a schematic cross-sectional view of the fixing unit 20.

In an example embodiment, the fixing unit 20 is detachable from the image forming apparatus 100 to conduct maintenance work of the fixing unit 20 and to solve sheet-jamming more easily.

The fixing unit 20 includes a fixing roller 21 and a pressure roller 22 as, shown in FIGS. 6 and 7. The fixing roller 21 and pressure roller 22 are maintained in a substantially contact condition with each other.

The fixing unit 20 also includes a drive-force input gear 23 and an idler gear 24 as shown in FIG. 7.

The fixing roller 21 includes a fixing roller gear (not shown) fixed on one shaft end of the fixing roller 21, and the fixing roller gear (not shown) engages the drive-force input gear 23.

The pressure roller 22 includes a pressure roller gear (not shown) fixed on one shaft end of the pressure roller 22, and the pressure roller gear (not shown) engages the idler gear 24.

Furthermore, the idler gear 24 engages the drive-force input gear 23 as shown in FIG. 7.

Accordingly, when the drive-force input gear 23 is rotated by a driving force transmitted from the image forming apparatus 100, the fixing roller 21 and pressure roller 22 can be rotated via rotation of the drive-force input gear 23 and idler gear 24 as shown in FIG. 7.

Figure 8:
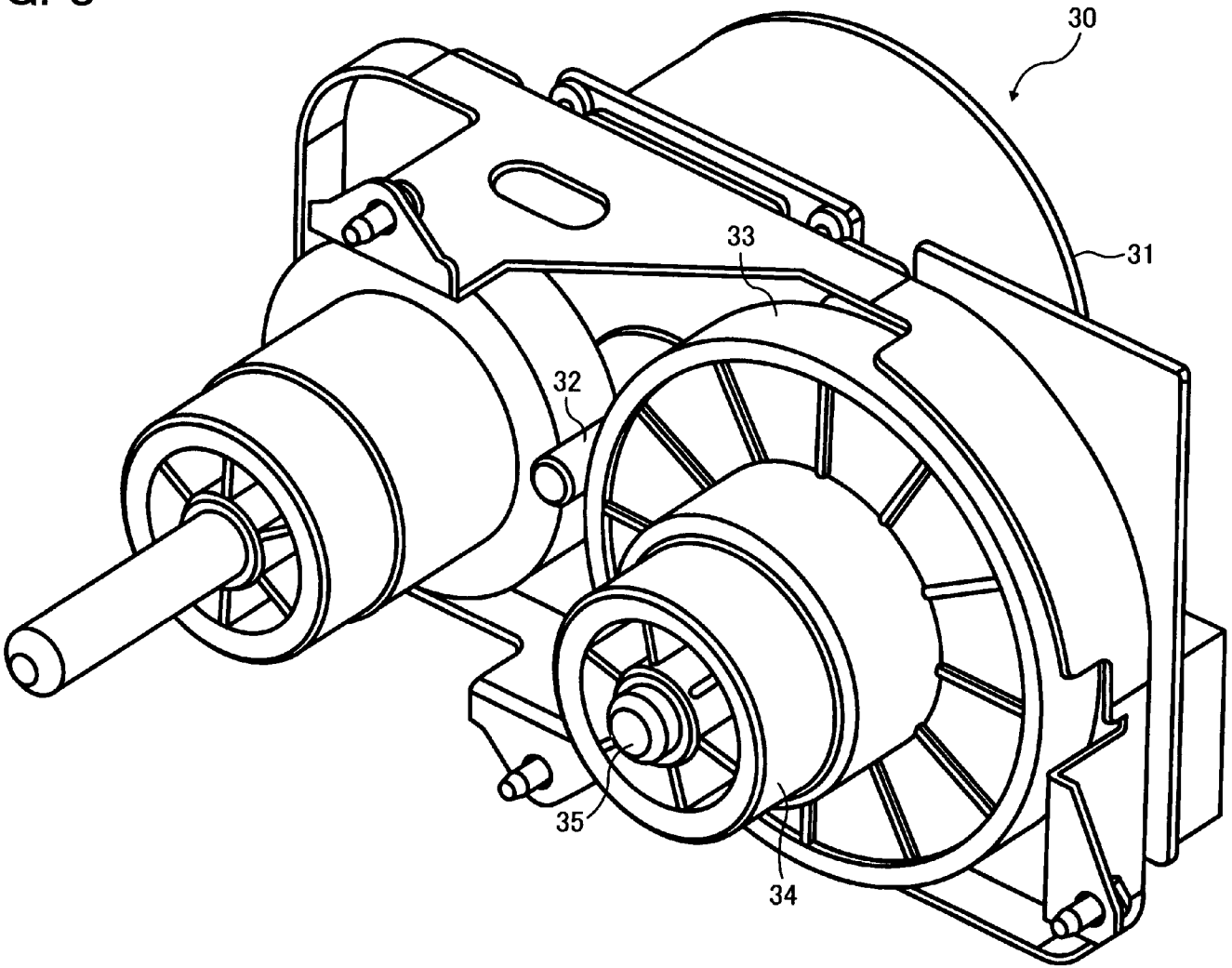
FIG. 8 is a perspective view of a drive-force transmission mechanism, provided in an image forming apparatus, for transmitting a driving force to a fixing unit in FIG. 6.

FIG. 8 is a perspective view of a drive-force transmission mechanism, provided in the image forming apparatus 100, for transmitting a driving force to the fixing unit 20.

As shown in FIG. 8, a drive-force transmission mechanism 30 includes a drive motor 31 as driver.

As shown in FIG. 8, a motor gear 32 is fixed on a motor shaft of the drive motor 31, and the motor gear 32 engages a drive gear 33 used as a first rotating member.

As shown in FIG. 8, a drive-force output gear 34, used as a second rotating member, is concentrically provided with the drive gear 33, and the drive gear 33 and drive force output gear 34 are supported by a rotational shaft 35.

In such a configuration, when the drive motor 31 is driven, the drive gear 33 is rotated via the motor gear 32. Then, the drive-force output gear 34 rotates with a rotation of the drive gear 33.

A drive-force transmission between the drive gear 33 and drive-force output gear 34 will be explained later. The drive-force output gear 34 engages the drive-force input gear 23 of the fixing unlit 20 when the fixing unit 20 is installed in the image forming apparatus 100.

Accordingly, the driving force of the drive motor 31 can be transmitted from the drive-force output gear 34 in the image forming apparatus 100 to the drive-force input gear 23 of the fixing unit 20, by which the fixing roller 21 and pressure roller 22 in the fixing unit 20 can be rotated.

Figure 9:
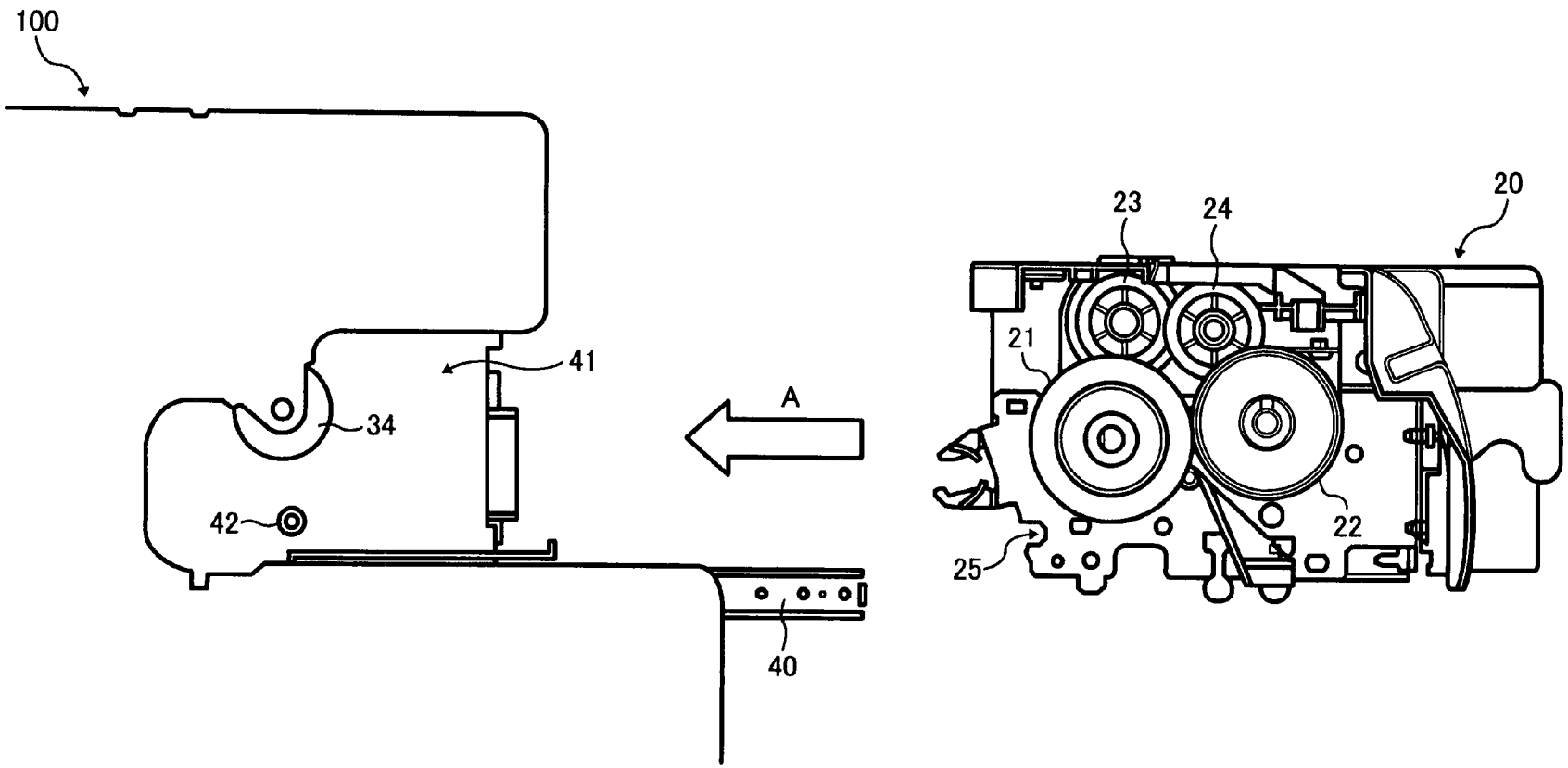
FIG. 9 is a schematic view explaining an installation process of a fixing unit in FIG. 6 into an image forming apparatus in FIG. 4.
Figure 10:
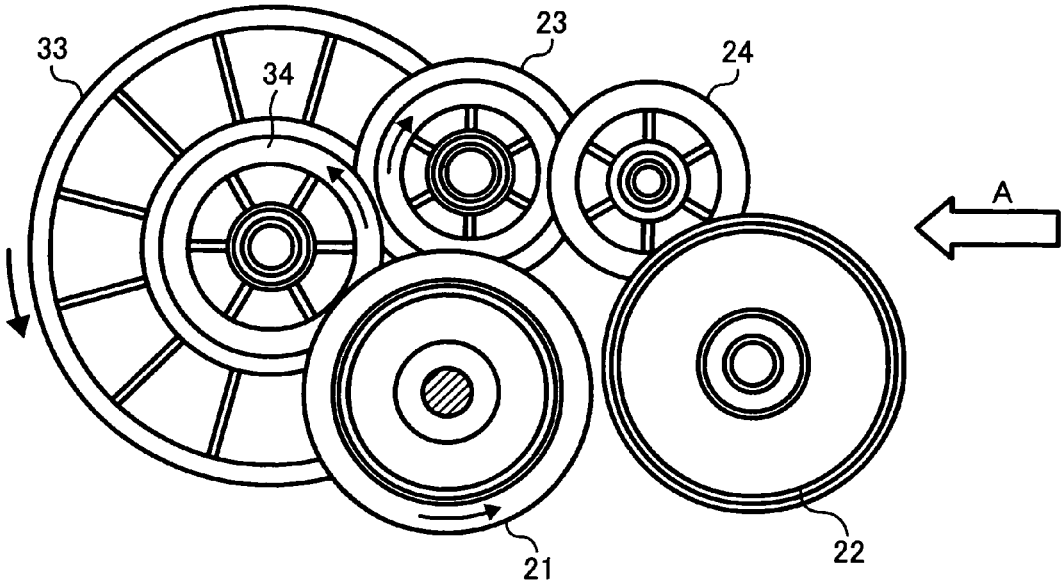
FIG. 10 is a schematic view explaining an engagement condition of gears when a fixing unit in FIG. 6 is installed in an image forming apparatus in FIG. 4.

FIG. 9 is a schematic view explaining an installation process of the fixing unit 20 into the image forming apparatus 100. FIG. 10 is a schematic view explaining an engagement condition of gears when the fixing unit 20 is installed in the image forming apparatus 100.

When installing the fixing unit 20 into the image forming apparatus 100, the fixing unit 20 is firstly set on a slide rail 40, provided in the image forming apparatus 100, as shown in FIG. 9.

Then, the fixing unit 20 can be moved in a direction shown by an arrow A in FIG. 9, and can be guided to an installation space 41 in the image forming apparatus 100 with a guide effect of the slide rail 40.

Then, a positioning pin 42 in the installation space 41 can be inserted in a pin receiver 25 formed on a casing of the fixing unit 20, by which the fixing unit 20 can be correctly set in the installation space 41 in the image forming apparatus 100.

When the fixing unit 20 is correctly set in the installation space 41 in the image forming apparatus 100, the drive-force input gear 23 of the fixing unit 20 can correctly engage the drive-force output gear 34 in the image forming apparatus 100 as shown in FIG. 10.

During the installation process of the fixing unit 20 into the image forming apparatus 100, the drive-force input gear 23 of the fixing unit 20 contacts the drive-force output gear 34 in the image forming apparatus 100.

If a tooth face of the drive-force input gear 23 and tooth face of the drive-force output gear 34 can contact each other with mountain-to-valley relationship for tooth faces of the two gears (i.e., gears 23 and 34), the drive-force input gear 23 and drive-force output gear 34 can be set with a correct engagement condition simply by further pushing the fixing unit 20 to an installation position in the installation space 41. In other words, involute curves of drive-force input gear 23 and drive-force output gear 34 are in a contact condition each other.

However, if the tooth face of the drive-force input gear 23 and tooth face of the drive-force output gear 34 contact each other with a mountain-to-mountain or valley-to-valley relationship for tooth faces of the two gears (i.e., gears 23 and 34), any one of the drive-force input gear 23 and drive-force output gear 34 is required to be rotated by some degree so that the drive-force input gear 23 and drive-force output gear 34 can be set in an engagement condition. After adjusting a contact condition of the drive-force input gear 23 and drive-force output gear 34 with such method, the fixing unit 20 can be further pushed into the installation position in the installation space 41.

The above-mentioned drive-force transmission mechanism 30 may integrally drive or rotate the drive motor 31 and drive-force output gear 34 in the image forming apparatus 100, and a drive-force transmission mechanism (not shown) in the fixing unit 20 may integrally drive or rotate the fixing roller 21, pressure roller 22, and drive-force input gear 23.

In such a configuration, if the tooth face of the drive-force input gear 23 and tooth face of the drive-force output gear 34 are in a contact condition with each other with mountain-to-mountain or valley-to-valley relationship for tooth faces of the two gears (i.e., gears 23 and 34), a load stress, which may be generated at the drive motor 31, fixing roller 21, and pressure roller 22, or other parts may be felt by a user (or operator) when the user (or operator) further pushes the fixing unit 20 into the installation space 41.

As shown in FIG. 8, the drive-force transmission mechanism 30 in the image forming apparatus 100 includes a two-step speed-changing mechanism configured with the drive gear 33 and drive-force output gear 34. As shown in FIG. 10, the fixing unit 20 includes the fixing roller 21, pressure roller 22, and drive-force input gear 23, which are connected to the drive-force transmission mechanism (not shown) in the fixing unit 20.

Therefore, if the user (or operator) further pushes the fixing unit 20 into the installation space 41 when the drive-force input gear 23 and drive-force output gear 34 are not in a correct engagement condition as above-mentioned, the user (or operator) may feel a larger load stress when pushing the fixing unit 20 into the installation space 41.

Therefore, when the user (or operator) installs the fixing unit 20 into the image forming apparatus 100, the user (or operator) needs a larger force to overcome the load stress when further pushing the fixing unit 20 into the installation space 41 when the drive-force input gear 23 and drive-force output gear 34 are not in a correct engagement condition.

Such condition may be unfavorable for a user to conduct an installation of the fixing unit 20 into the image forming apparatus 100.

Figure 11:
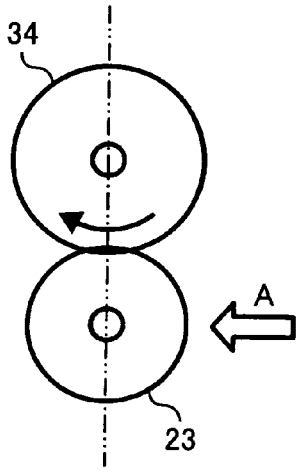
FIG. 11 is a schematic view explaining that an installation direction of a fixing unit in FIG. 6 is perpendicular to a line connecting a rotational shaft of drive-force output gear and a rotational shaft of drive-force input gear when a fixing unit in FIG. 6 is installed in an image forming apparatus in FIG. 4.

FIG. 11 is a schematic view explaining when an installation direction of the fixing unit 20 is perpendicular to a line connecting a rotational shaft of drive-force output gear 34 and a rotation shaft of drive-force input gear 23 when the fixing unit 20 is installed into the image forming apparatus 100.

If the fixing unit 20 is moved in a direction shown by an arrow A in FIG. 11 when installing the fixing unit 20 into the image forming apparatus 100, the drive-force input gear 23 is also moved in the direction shown by an arrow A.

If the moving direction the drive-force input gear 23 is perpendicular to a line connecting a rotational shaft of drive-force output gear 34 and a rotational shaft of drive-force input gear 23 as shown in FIG. 11, the drive-force input gear 23 or drive-force output gear 34 may need to rotate with a larger degree so that the fixing unit 20 can be further pushed into the installation space 41 after the drive-force input gear 23 contacts the drive-force output gear 34.

Such condition may be further unfavorable for the user (or operator) to conduct installation of the fixing unit 20 into the image forming apparatus 100.

Figure 12:
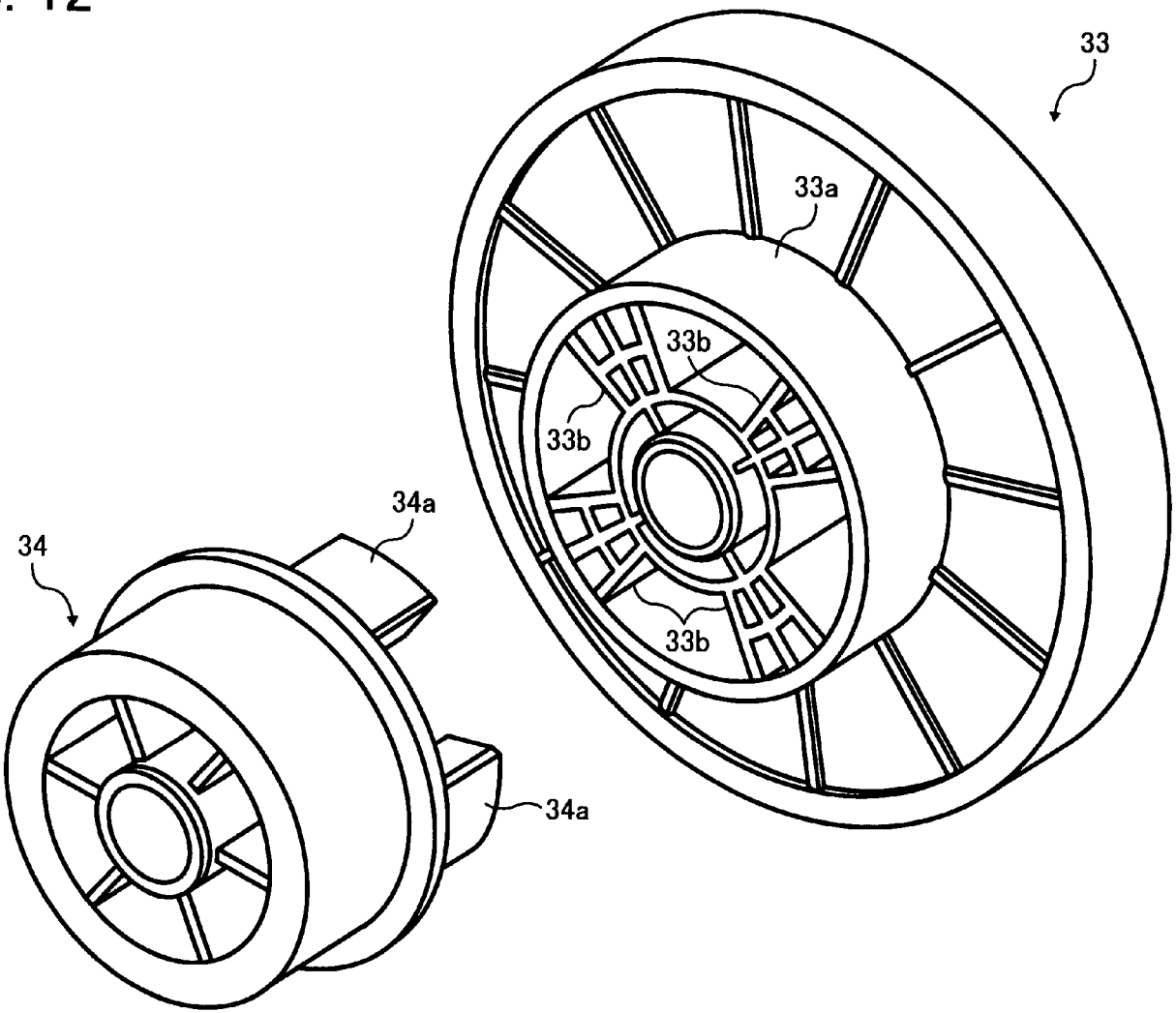
FIG. 12 is an exploded view of a drive gear and a drive-force output gear in an image forming apparatus in FIG. 4.
Figure 13:
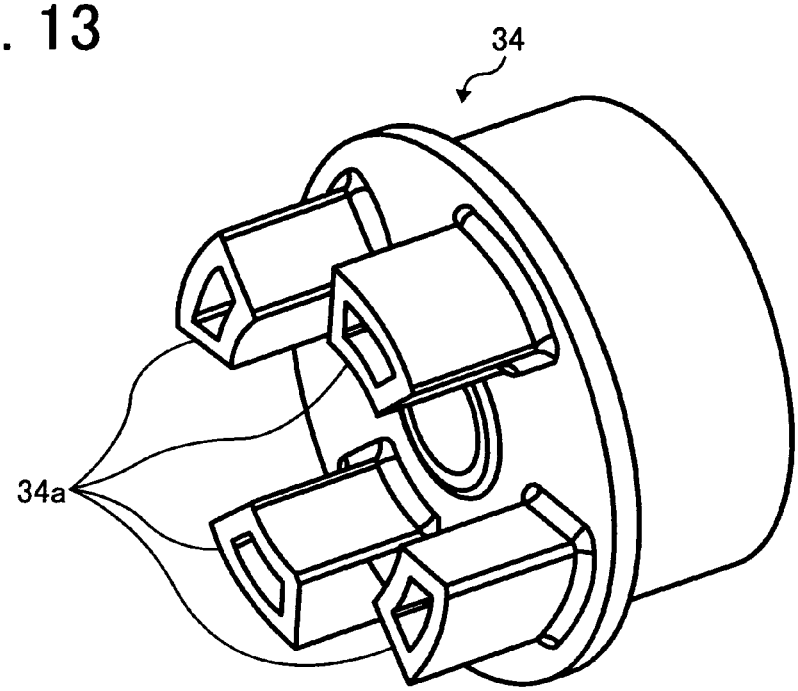
FIG. 13 is a perspective view of a drive-force output gear in FIG. 12.

FIG. 12 is an exploded view of the drive gear 33 and drive-force output gear 34. FIG. 13 is a perspective view of the drive-force output gear 34.

The drive gear 33 and drive-force output gear 34, which are supported with the rotational shaft 35, configure a two-step speed-changing mechanism.

As shown in FIG. 12, the drive gear 33 and drive-force output gear 34 are not integrated parts, but the drive gear 33 and drive-force output gear 34 are separate parts.

As shown in FIG. 13, the drive-force output gear 34 includes a plurality of projections 34*a* formed integrally with the drive-force output gear 34, wherein the projections 34*a* project in an axial direction of the drive-force output gear 34 and face the drive gear 33.

The projections 34*a* are provided with the same interval on the circumference of the drive-force output gear 34.

As shown in FIG. 12, the drive gear 33 includes a holder 33*a*, which is projected from the drive gear 33 and faces the drive-force output gear 34.

The holder 33*a* includes a plurality of holding spaces therein as shown in FIG. 12, wherein the plurality of holding spaces are formed by providing a plurality of separators 33*b* in the holder 33*a* as shown in FIG. 12.

Accordingly, the holder 33*a* can receive the plurality of projections 34*a* of the drive-force output gear 34.

As shown in FIG. 12, the plurality of separators 33*b* are provided with the same interval on the circumference of the holder 33*a*.

The dimensions of the holding spaces in the holder 33*a* is set larger than the dimensions of the projections 34*a* of the drive-force output gear 34.

When the drive gear 33, drive-force output gear 34, and rotation shaft 35 are assembled with each other, the drive gear 33 and drive-force output gear 34 are relatively rotatable in a range of 3600 degree on the rotation shaft 35.

By rotating the drive gear 33 or drive-force output gear 34 on the rotation shaft 35, the projections 34*a* of the drive-force output gear 34 can be inserted into the holding spaces in the holder 33*a* of the drive gear 33.

In an exemplary embodiment, the drive gear 33 and drive-force output gear 34 are relatively rotatable in a range of 300 degree with respect to the rotational shaft 35 when the drive gear 33 and drive-force output gear 34 are assembled each other.

Because the drive gear 33 and drive-force output gear 34 are assembled with the rotational shaft 35 as above described, a driving force can be transmitted to the drive gear 33 and drive-force output gear 34 from the drive motor 31.

When to transmit the driving force of the drive motor 31 to the drive gear 33 and the drive-force output gear 34, the drive gear 33 is rotated in one rotational direction with respect to the drive-force output gear 34 by using a driving force of the drive motor 31 at first.

If a gap exists between the separators 33*b* and projections 34*a* in the holding space of the drive gear 33, the drive-force output gear 34 does not start to rotate until the separator 33*b* can contact the projections 34*a*.

When the separators 33*b* contact the projections 34*a*, the drive-force output gear 34 starts to rotate with the drive gear 33, by which a driving force of the drive motor 31 can be transmitted to the drive-force output gear 34 via the drive gear 33.

During installation of the fixing unit 20 into the image forming apparatus 100, the drive-force input gear 23 of the fixing unit 20 contacts the drive-force output gear 34 in the image forming apparatus 100.

If the tooth face of the drive-force input gear 23 and tooth face of the drive-force output gear 34 contact each other with a mountain-to-mountain or valley-to-valley relationship for tooth faces of the two gears (i.e., gears 23 and 34), the drive-force output gear 34 may rotate some degree in the holding space of the holder 33*a* of the drive gear 33 so that the fixing unit 20 can be further pushed to the installation position in the installation space 41.

In an exemplary embodiment, the drive gear 33 and drive-force output gear 34 are relatively rotatable in a range of 300 degree with each other on the rotational shaft 35. With such configuration, the drive gear 33 can be rotated by some degree with respect to the drive-force output gear 34 before the projections 34*a* contacts the separators 33*b*.

Therefore, the drive-force output gear 34 and the drive gear 33 may not receive a load stress from the drive motor 31, fixing roller 21, and pressure roller 22 when the drive gear 33 rotates with respect to the drive-force output gear 34.

Accordingly, during installation of the fixing unit 20 into the image forming apparatus 100, the user (or operator) may not feel load stress from drive-force transmission mechanism such as drive motor 31, fixing roller 21, and pressure roller 22 when the user further pushes the fixing unit 20 into the installation space 41 after the drive-force input gear 23 contacts the drive-force output gear 34 each other.

Accordingly, installation of the fixing unit 20 into the image forming apparatus 100 can be conducted with a smaller force.

In an exemplary embodiment, a relatively rotatable range of the drive gear 33 with respect to the drive-force output gear 34 can be determined based on the dimension of play which is set between the projections 34*a* of drive-force output gear 34 and separators 33*b* of drive gear 33.

The dimension of play can be set in any value, as required, by considering factors such as a number of projections 34*a* and separator 33*b*, and a whole dimension of drive-force output gear 34 and drive gear 33.

In an exemplary embodiment, the plurality of projections 34*a* and separators 33*b* contact each other to transmit a rotating force of the drive gear 33 to the drive-force output gear 34.

If only one projection and one separator is used to transmit a rotating force of the drive gear 33 to the drive-force output gear 34, a force applied to the one projection and one separator becomes greater compared to using the plurality of projections 34*a* and separators 33*b* according to an exemplary embodiment.

In an exemplary embodiment, the total force applied to the drive gear 33 and drive-force output gear 34 can be distributed to the plurality of the projections 34*a* and separators 33*b*, by which the lifetime of the projections 34*a* and separators 33*b* can be made longer compared to using only one projection and one separator.

Figure 14:
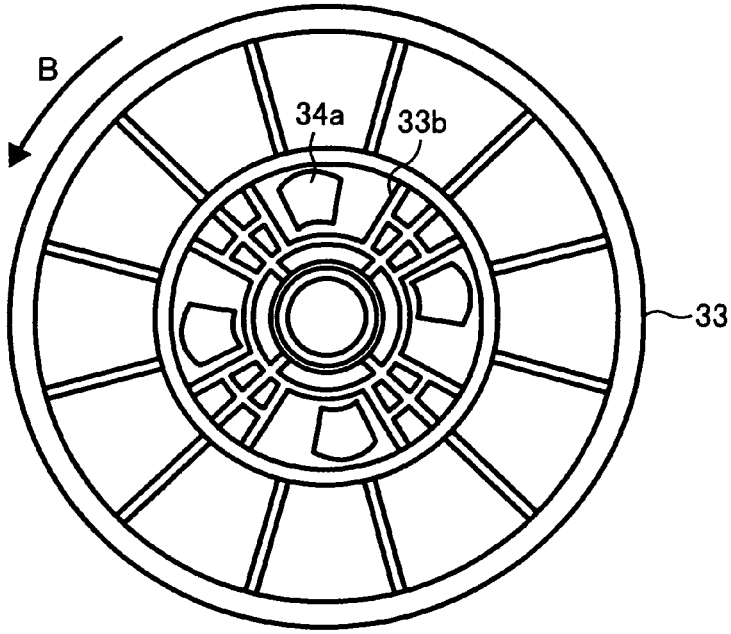
FIG. 14 is a schematic view explaining a positional relationship of a separator of drive gear and a projection of drive-force output gear right after installation of a fixing unit in FIG. 6 in an image forming apparatus in FIG. 6.

When the fixing unit 20 is installed in the image forming apparatus 100, the separators 33*b* of drive gear 33 and the projections 34*a* of drive-force output gear 34 may not be in a contact condition each other as shown in FIG. 14.

In order to transmit the driving force of the drive motor 31 to the fixing unit 20 installed in the image forming apparatus 100, the separators 33*b* of drive gear 33 and the projections 34*a* of drive-force output gear 34 need to be in contact with each other.

The separators 33*b* and projections 34*a* can be contacted with each other by rotating the drive gear 33 in a direction shown by an arrow B in FIG. 14 by using a drive force of the drive motor 31, for example.

If the separators 33*b* and projections 34*a* are not in a contact condition as shown FIG. 14 after installing the fixing unit 20 in the image forming apparatus 100, the separators 33*b* may impact the projections 34*a* with a relatively larger force when the drive gear 33 is rotated by using a drive force of the drive motor 31 for the first time after installing the fixing unit 20 in the image forming apparatus 100.

If the drive motor 31 is driven with a normal driving power used for actual image forming operating under a condition shown in FIG. 14, the separators 33*b* of the drive gear 33, driven by the driving force of the drive motor 31, may impact the projections 34*a* with a relatively higher speed, by which the impact shock between the separators 33*b* and projections 34*a* may become greater.

Especially, if a dimension of the play is set to a larger value to facilitate an installation of the fixing unit 20 into the image forming apparatus 100 more easily, the separators 33*b* and projections 34*a* may be distanced apart with each other in a greater degree after an installation of the fixing unit 20. If the separator 33*b* of the drive gear 33 are rotated under such condition with the drive motor 31, driven at the normal driving power, the separators 33*b* may impact the projections 34*a* with an even higher speed, by which an impact shock between the separators 33*b* and projections 34*a* may become furthermore greater.

In order to cope with such situation, the following control process can be conducted in the image forming apparatus 100. With following control process, an impact shock between the separators 33*b* and projections 34*a* can be suppressed to a smaller level.

Figure 15:
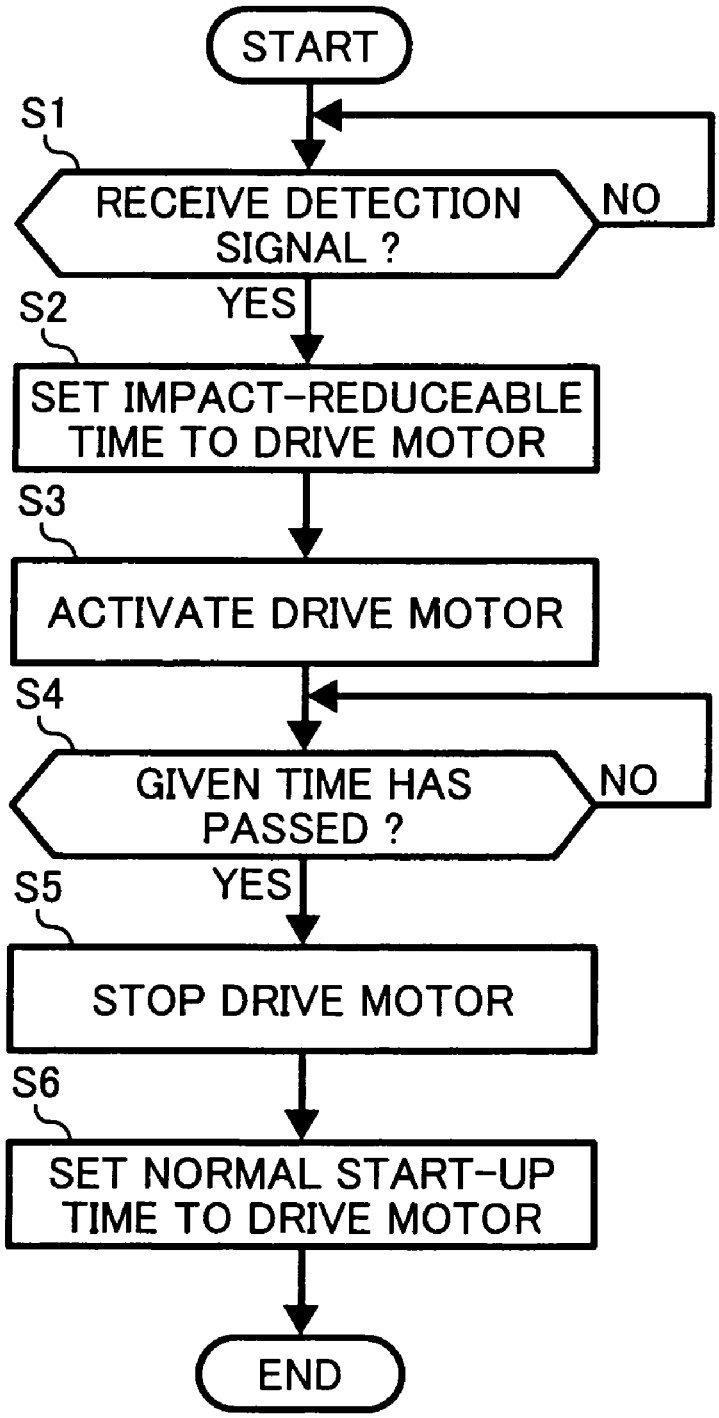
FIG. 15 is a flow chart explaining a control process by a drive unit controller after installation of a fixing unit in FIG. 6 in an image forming apparatus in FIG. 4.

FIG. 15 is a flow chart explaining a control process by a drive unit controller (not shown) of the image forming apparatus 100 for controlling the drive motor 31 after an installation of the fixing unit 20 in the image forming apparatus 100.

Figure 16:
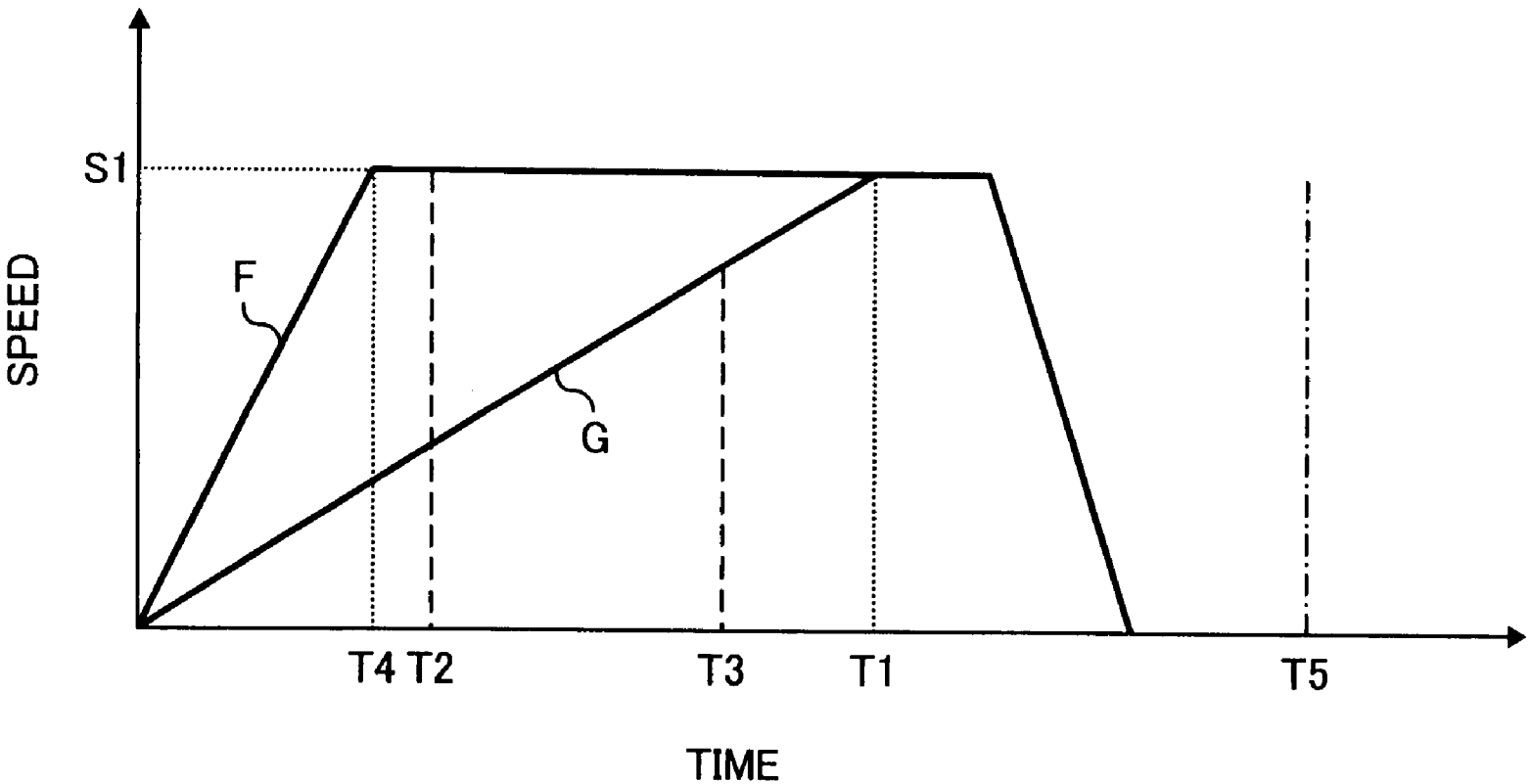
FIG. 16 is a schematic graph explaining a speed profile of a driving motor used for a control process shown in FIG. 15.

FIG. 16 is a schematic graph explaining the speed profile of the driving motor 31 used for the control process shown in FIG. 15.

After installing the fixing unit 20 in the image forming apparatus 100, an openable cover (not shown) of the image forming apparatus 100 is closed to complete an installation process of the fixing unit 20 into the image forming apparatus 100.

The image forming apparatus 100 includes a cover sensor (not shown) to detect an opened/closed condition of the openable cover (not shown). When the cover sensor detects the closed condition of the openable cover, the cover sensor transmits a detection signal of closed condition to the drive unit controller (not shown).

At step S1 shown in FIG. 15, the drive unit controller receives a detection signal of closed condition of the openable cover from the cover sensor. A CPU (control process unit) of drive unit controller judges that an installation of the fixing unit 20 into the image forming apparatus 100 has completed when such detection signal is received.

At step S2, the CPU sets an impact-reduceable time T1 to the drive motor 31.

Hereinafter, an example relationship of timing related to the control of the drive motor 31 is explained with reference to FIG. 16, in which five timings T1, T2, T3, T4, and T5 are shown.

The impact-reduceable time T1 is a time, which is set for contacting the separators 33*b* and projections 34*a* while suppressing an impact shock of the separators 33*b* and projections 34*a*, in which the drive motor 31 is driven with a slower speed, indicated by a gradient of line G in FIG. 16.

When the drive motor 31 is driven with a normal driving power, indicated by a gradient of line F, the drive, motor 31 can be set to a speed S1 with a normal start-up time T4 as shown in FIG. 16, wherein the drive motor 31 is driven with the normal driving power when to start an actual image forming operation in the image forming apparatus 100. If the drive motor 31 is driven at the speed S1 from the normal startup time T4, the separators 33*b* and projections 34*a* can be in a contact condition at a time T2 shown in FIG. 16.

Therefore, if the drive motor 31 is driven with the normal driving power indicated by the line F, the separators 33*b* and projections 34*a* can be in a contact condition at the time T2, which is faster than the impact-reduceable time T1 as shown in FIG. 16.

If the drive motor 31 is driven with the slower speed indicated by the line G in FIG. 16, the separators 33*b* and projections 34*a* may start to contact each other after a given time T3, shown in FIG. 16, has passed. Therefore, after the given time T3 has passed, the separators 33*b* and projections 34*a* may start to rotate integrally.

At the given time T3, the drive motor 31 is deactivated to stop its rotation. As shown in FIG. 16, the given time T3 may come before the impact-reduceable time T1.

Going back to the flowchart in FIG. 15, at step S3, the CPU transmits a signal to the drive motor 31 to activate the drive motor 31 with the impact-reduceable time T1 set at step S2.

At step S4, the CPU judges whether the given time T3 has passed or not after activating the drive motor 31.

As above-mentioned, the separators 33*b* and projections 34*a* may start to contact with each other and to rotate integrally after the given time T3 when the drive motor 31 is driven with the slower speed indicated by the line G in FIG. 16.

If the CPU judges that the given time T3 has passed after activating the drive motor 31, the CPU transmits a signal to the drive motor 31, which instructs a stop (or deactivation) of the drive motor 31 at step S5.

When step S5 is completed, the separators 33*b* and projections 34*a* are set in a contact condition each other.

Accordingly, the image forming apparatus 100 are almost ready to conduct an image forming operation.

However, when the fixing unit 20 is installed in the image forming apparatus 100, a heating member such as heat roller in the fixing unit 20 is required to be heated to a given temperature, and such heating process may take some time, which is indicated by a time T5 in FIG. 16.

Then, at step S6, the CPU sets the normal start-up time T4 to the drive motor 31, wherein the drive motor 31 is activated with the normal start-up time T4 when the image forming apparatus 100 conducts an actual image forming operation.

Accordingly, the separators 33*b* and projections 34*a*, which are in a non-contact condition when the fixing unit 20 is installed in the image forming apparatus 100, can be in a contact condition before starting an image forming operation in the image forming apparatus 100.

Therefore, when the drive motor 31 is activated for image forming operation for the first time after installing the fixing unit 20 in the image forming apparatus 100, the separators 33*b* and projections 34*a* are set in a contact condition each other.

As a result, the separators 33*b* and projections 34*a* may not impact each other when an image forming operation is conducted for the first time after installing the fixing unit 20 in the image forming apparatus 100.

Furthermore, the above-described process for contacting separators 33*b* and projections 34*a* can be started by detecting a signal from the cover sensor. Therefore, the image forming apparatus 100 can be set in an print-ready condition in a shorter period of time after the installation of the fixing unit 20 by which the image forming apparatus 100 can conduct a first time printing with a shorter period of time after the installation of the fixing unit 20 in the image forming apparatus 100.

As shown in FIG. 16, when the impact-reduceable time T1 is set for the drive motor 31, the drive motor 31 increase its rotating speed with a gradient indicated by the line G, therefore the drive motor 31 is still accelerating its rotating speed along the line G when the separator 33*b* and the projections 34*a* becomes into a contact condition each other at the given time T3.

Therefore, the rotating speed of the drive motor during the impact-reduceable time T1 (see line G) is slower, than a rotating speed of the drive motor 31 during a normal image forming operation (see line F).

If the separators 33*b* and projections 34*a* impact each other under a condition that the drive motor 31 is driven along the line F used for normal image forming operation, the separator 33*b* may be impacted with the projection 34*a* with a greater force, which is not favorable from a viewpoint of lifetime of the separators 33*b* and projections 34*a*.

In an exemplary embodiment, such impact effect between the separators 33*b* and projections 34*a* can be suppressed because a driving speed (or accelerating speed) of the drive motor 31 driven along the line G is slower than a driving speed (or accelerating speed) of the drive motor 31 driven along the line F shown in FIG. 16. Therefore, the lifetime of the separators 33*b* and projections 34*a* can be favorably extended for a longer period of time.

Furthermore, before conducting an image forming operation for the first time after installing the fixing unit 20 in the image forming apparatus 100, the separators 33*b* may be in a contact condition with the projections 34*a* by using a bias force of elastic member such as spring and rubber instead of the driving force of the drive motor 31. With such method, when the drive motor 31 is activated for image forming operation for the first time after installing the fixing unit 20 in the image forming apparatus 100, an impact shock between the separators 33*b* and projections 34*a* can be prevented. However, such bias force of the elastic member needs to be greater than a load stress caused by drive-force transmission mechanism such as drive motor 31, fixing roller 21, and pressure roller 22. Because such load stress is relatively greater, a force which is greater than such load stress is difficult to be generated by the elastic member with a reasonable cost configuration for the image forming apparatus 100.

Therefore, in the exemplary embodiment, an impact shock between the separators 33*b* and projections 34*a* can be suppressed by controlling a driving force of the drive motor 31 for contacting the separators 33*b* and projections 34*a*, wherein such method may not increase a manufacturing cost of the image forming apparatus 100.

Furthermore, in such exemplary embodiment, a plurality of driven units used for image forming operation such as photoconductive drum unit can be stopped when the drive unit controller conducts the above-described operation (hereinafter, impact-effect reducing control) for contacting the projections 34*a* and separators 33*b*.

If such plurality of driven units is stopped when the drive unit controller conducts the impact effect reducing control, a noise generated by such plurality of driven units can be suppressed, by which a quieter condition can be obtained. Furthermore, if such plurality of driven units are stopped, an energy saving can be improved for the image forming apparatus 100.

Furthermore, the image forming apparatus 100 includes the cover sensor to detect installation of the fixing unit 20 in the image forming apparatus 100. The drive unit controller (not shown) can start the impact effect reducing control when the cover sensor detects a closed condition of the cover. With such configuration, the impact effect reducing control can be conducted right after the installation of the fixing unit 20 into the image forming apparatus 100, by which the image forming apparatus 100 can start for a first time printing operation within a shorter period of time after the installation of the fixing unit 20.

In the above-discussed example embodiment, the fixing unit 20 is exemplified as one driven unit in the image forming apparatus 100. However, the above-discussed example embodiment can be similarly applied to other driven units such as process cartridges 6Y, 6M, 6C, and 6K, wherein each of the process cartridges 6Y, 6M, 6C, and 6K includes at least one of photosensitive drum 1, charging unit 4, developing unit 5, and cleaning unit 2.

In general, the process cartridges 6Y, 6M, 6C, and 6K include consumable components to be replaced with a higher frequency. Therefore, maintenance and replacement work for the process cartridges 6Y, 6M, 6C, and 6K can be conducted more efficiently by applying the above-discussed example embodiment to the process cartridges 6X, 6M, 6C, and 6K.

In the above-discussed example embodiment, the drive gear 33 and drive-force output gear 34 are relatively rotatable on the rotation shaft 35.

However such relatively rotatable relationship can be similarly set to a drive-force transmission mechanism provided between the drive-force input gear 23 and fixing roller 21 (or pressure roller 22).

For example, the drive-force input gear 23 may be contacted with an intermediate gear (not shown), which is disposed between the drive-force input gear 23 and the fixing roller 21 (or pressure roller 22). In case of such configuration, the drive-force input gear 23 and intermediate gear (not shown) may have a similar configuration of the drive gear 33 (having the separators 33*b*) and that of the drive-force output gear 34 (having the projections 34*a*) and may be controlled by the drive control unit in the image forming apparatus 100 with the above-described control method shown in FIG. 15 and FIG. 16.

Furthermore, in the above-discussed example embodiment, the fixing roller 21 and pressure roller 22 are used. However, the fixing roller 21 and pressure roller 22 can be modified so as to be a belt-shaped member, as required.

Numerous additional modifications and variations are possible in light of the above teachings. It is therefore to be understood that within the scope of the appended claims, the disclosure of the present invention may be practiced otherwise than as specifically described herein.

This application claims priority from Japanese patent application No. 2005-229188 filed on Aug. 8, 2005 in the Japan Patent Office, the entire contents of which is hereby incorporated by reference herein.

The invention claimed is:

1. An image forming apparatus, comprising:

a driver unit integrated to the image forming apparatus;

a drive gear, having a first contact portion and connected to the driver unit, configured to be driven with a driving force of the driver unit;

a drive-force output gear, having a second contact portion and connected to the drive gear with a common shaft, configured to be driven with the drive gear, the drive-force output gear being relatively rotatable with respect to the drive gear;

a driven unit, detachably provided in the image forming apparatus, comprising:

a rotating member; and a drive-force input gear configured to be connected to the rotating member to rotate the rotating member, the drive-force input gear being contactable with the drive-force output gear when the driven unit is installed into the image forming apparatus, and engageable with the drive-force output gear with a rotation of at least one of the drive-force input gear and drive-force output gear in one direction;

wherein the drive gear is rotated by the driving force of the driver unit to contact the first contact portion of the drive gear to the second contact portion of the drive-force output gear after installing the driven unit in the image forming apparatus so that the drive gear and drive-force output gear are integrally rotatable, and wherein the driver unit is driven at a first driving speed to rotate the drive gear, by which the first contact portion of the drive gear is contacted to the second contact portion of the drive-force output gear, and the driver unit is driven at a second driving speed, by which the image forming apparatus conducts an image forming operation after the first contact portion of the drive gear is contacted to the second contact portion of the drive-force output gear, and the first driving speed is set to a slower speed as compared to the second driving speed wherein the driver unit is driven at the first driving speed after installing the driven unit in the image forming apparatus, the driver unit is deactivated when the first contact portion of the drive gear and the second contact portion of the drive-force output gear contact each other, and the driver unit is then driven at the second driving speed to conduct an image forming operation; and wherein the driver unit is driven at the first driving speed to contact the first contact portion of the drive gear to the second contact portion of the drive-force output gear while operation of another driven unit provided in the image forming apparatus is stopped.

2. The image forming apparatus according to claim 1, wherein a first start-up time is set for the driver unit when the driver unit is driven at the first driving speed to contact the first contact portion of the drive gear to the second contact portion of the drive-force output gear after installing the driven unit in the image forming apparatus, and a second start-up time is set for the driver unit when the driver unit is driven at the second driving speed to conduct an image forming operation, and wherein the first start-up time is set to a longer time as compared with the second start-up time.

3. The image forming apparatus according to claim 1, further comprising a detector configured to detect installation of the driven unit in a given installation position in the image forming apparatus, wherein the the driver unit is controlled with the first driving speed when a signal indicating a completion of the installation of the driven unit in the image forming apparatus is received by the drive unit from the detector.

4. The image forming apparatus according to claim 1, wherein the driven unit includes a process cartridge, which has at least one of an image carrying member configured to carry a latent image, a charge unit configured to uniformly charge a surface of the image carrying member, a developing unit configured to develop the latent image on the surface of the image carrying member, and a cleaning unit configured to clean the surface of the image carrying member.

5. The image forming apparatus according to claim 1, wherein the driven unit includes a fixing unit.

6. A method of installing a driven unit in an image forming apparatus having a drive gear, a drive-force output gear and a driver unit, which comprises:

receiving a signal indicating an installation of the driven unit in the image forming apparatus, in which the driven unit is engaged with the drive-force output gear;

firstly setting a first start-up time and a first driving speed to the driver unit to contact a first contact portion of the drive gear to a second contact portion of the drive-force output gear;

activating the driver unit with the first start-up time and first driving speed to rotate the drive gear with respect to the drive-force output gear;

judging whether a given time has passed after activating the driver unit, wherein the first contact portion of the drive gear starts to contact the second contact portion of the drive-force output gear at the given time;

deactivating the driver unit when the given time has passed after activating the driver unit; and secondarily setting a second start-up time and a second driving speed to the driver unit to start an image forming operation, wherein the second start-up time and second driving speed are set smaller than the first startup time and the first driving speed, respectively.

7. An image forming apparatus, comprising:

a driver unit integrated to the image forming apparatus;

a drive gear configured to be driven with a driving force of the driver unit;

a drive-force output gear configured to be driven with the drive gear;

a driven unit, detachably provided in the image forming apparatus, comprising:

a rotating member;

a drive-force input gear, having a first contact portion and contactable with the drive-force output gear when the driven unit is installed in the image forming apparatus; and an intermediate gear, having a second contact portion and connected to the drive-force input gear with a common shaft by contacting the second contact portion to the first contact portion of the drive-force input gear, the intermediate gear being contacted with the rotating member to rotate the rotating member, the intermediate gear being relatively rotatable with respect to the drive-force input gear, wherein the drive-force input gear is rotated by the driving force of the driver unit to contact the first contact portion of the drive-force input gear to the second contact portion of the intermediate gear after installing the driven unit in the image forming apparatus so that the drive-force input gear and intermediate gear are integrally rotatable, and wherein the driver unit is driven at a first driving speed to rotate the drive-force input gear, by which the first contact portion of the drive-force input gear is contacted to the second contact portion of the intermediate gear, and the driver unit is driven at a second driving speed, by which the image forming apparatus conducts an image forming operation after the first contact portion of the drive-force input gear is contacted to the second contact portion of the intermediate gear, and wherein the first driving speed is set to a slower speed as compared to the second driving speed.

* * * * *